United States Patent [19]

Pezzoli

[11] Patent Number: 4,757,844

[45] Date of Patent: Jul. 19, 1988

[54] WEFT GRIPPERS FOR SHUTTLELESS WEAVING LOOMS

[75] Inventor: Luigi Pezzoli, Leffe, Italy

[73] Assignee: Vamatex S.p.A., Villa Di Serio, Italy

[21] Appl. No.: 46,262

[22] Filed: May 5, 1987

[51] Int. Cl.[4] ..... D03D 47/20

[52] U.S. Cl. ..... 139/448

[58] Field of Search ..... 139/448, 447

[56] References Cited

U.S. PATENT DOCUMENTS 3,842,867 10/1974 Volpe .
4,226,265 10/1980 Zollinger .
4,271,873 6/1981 Genini .

FOREIGN PATENT DOCUMENTS 0164034 12/1985 European Pat. Off. ..... 139/448
2644505 4/1977 Fed. Rep. of Germany .
2278815 2/1976 France .

*Primary Examiner*—Henry S. Jaudon
*Attorney, Agent, or Firm*—Young & Thompson

[57] ABSTRACT

A pair of weft grippers for moving weft yarn through a shuttleless weaving loom, comprises a carrying gripper for carrying the weft partway into the sheds of the loom and a drawing gripper for thereafter receiving and completing the passage of the yarn through the sheds. Each gripper has a body of solid synthetic resin faced on opposite sides with sheet steel that is partially embedded in the resin by molding. The spaced-apart steels shells impart great rigidity and wear resistance to the body, at the same time that the plastic body between the shells achieves light weight and low cost of the gripper.

5 Claims, 3 Drawing Sheets

WEFT GRIPPERS FOR SHUTTLELESS WEAVING LOOMS

BACKGROUND OF THE INVENTION

The present invention relates to weft grippers for shuttleless weaving looms, namely, those members by which the weft yarns are inserted at one end of the loom and are carried to the opposite end thereof through the warp sheds. One type of gripper, called the "carrying gripper", carries the weft to the center of the sheds and there passes it to another type of gripper, called the "drawing gripper", by which the weft is carried the rest of the way through the sheds. The present invention is generic to both types of gripper.

Until now, such grippers have been made either of metal or of synthetic resin. Metal grippers are too heavy and are very expensive. Synthetic resin grippers are not sufficiently stiff. Thus, neither type of gripper known until now, is entirely satisfactory when used in modern looms working at very high speeds.

SUMMARY OF THE INVENTION

The present invention solves the problem of providing sufficiently rigid yet low cost and light weight grippers for carrying weft yarn through the sheds, by taking advantage of the desirable characteristics of metal grippers and of synthetic resin grippers, while at the same time eliminating the drawbacks of both.

For this purpose, a weft gripper according to the present invention is formed of a composite or sandwich structure consisting of two metal shells rigidly connected by a central body of synthetic resin into which the metal shells are partially embedded by injection molding. The shells are spaced apart from each other by the central body of synthetic resin, and are preferably provided with hooks, projections, recesses or the like for anchorage to the central body of synthetic resin. The metal shells are exposed on opposite sides of the central body, whereby not only wear resistance but also maximum resistance to bending are achieved.

BRIEF DESCRIPTION OF THE DRAWINGS

Other features and advantages of the present invention will become apparent from a consideration of the following description, taken in connection with the accompanying drawings, in which.

DETAILED DESCRIPTION OF THE DRAWINGS

Figure 1:
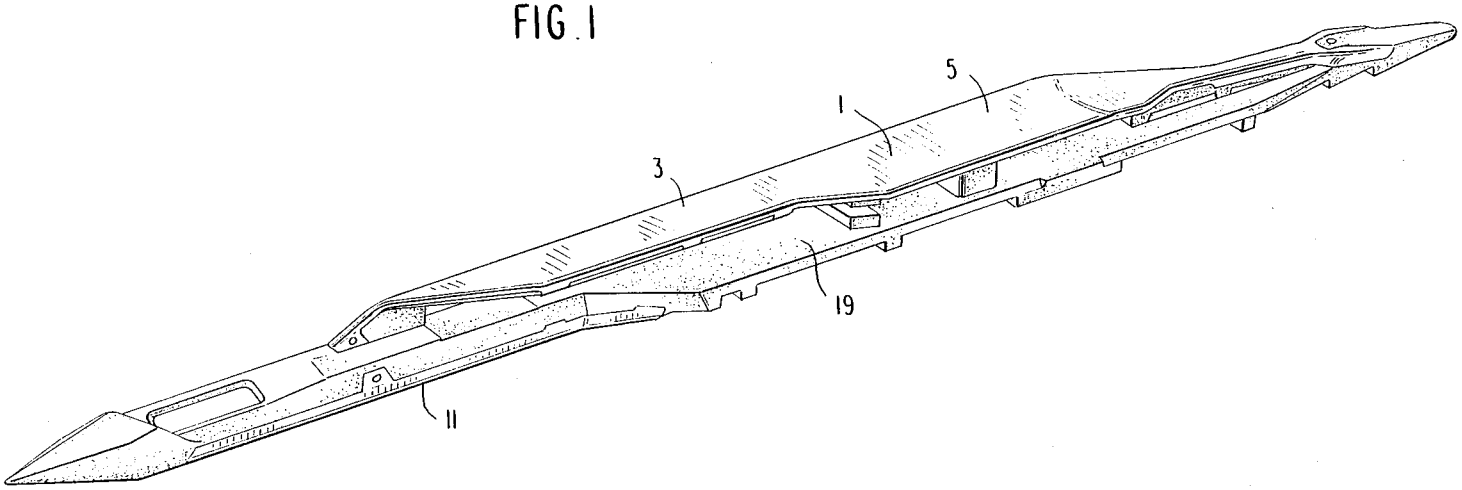
FIG. 1 is a perspective view of the body of a carrying gripper according to the present invention.

Referring now to the drawings in greater detail, and first to FIGS. 1–5 thereof, there is shown the body 1 of a carrying gripper according to the present invention. It is of course to be understood that body 1 serves as a support for gripping and operating mechanism by which weft yarns can be selectively gripped and released. These mechanisms are not shown in the present drawings because they form no part of the present invention. For a full disclosure of the operative mechanism of such a carrying gripper, the disclosure of U.S. application Ser. No. 740,034, filed May 31, 1985 is incorporated herein by reference.

Figure 2:
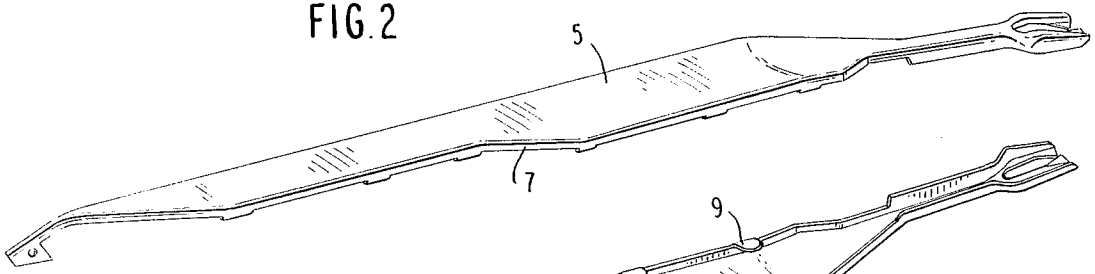
FIG. 2 is a view from the same angle as in FIG. 1, of the upper metal shell alone.
Figure 3:
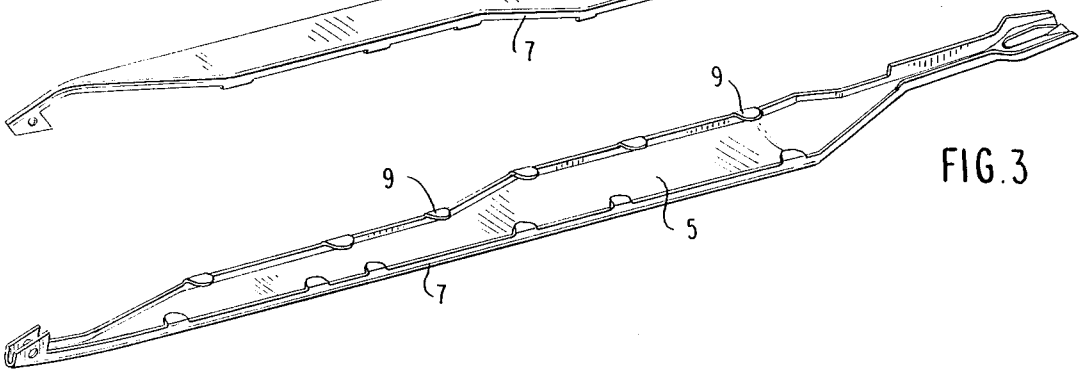
FIG. 3 is a perspective view of the underside of the upper metal shell of FIG. 2.
Figure 7:
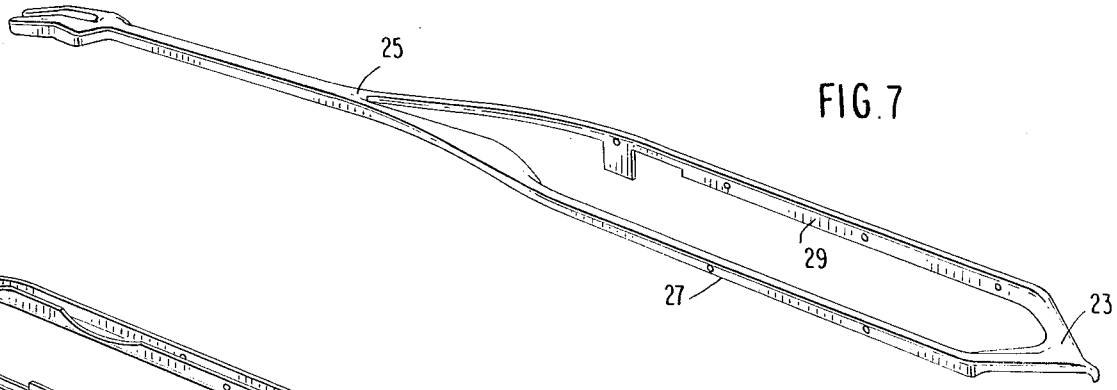
FIG. 7 is a perspective view, from the same angle as FIG. 6, of the upper metal shell of the drawing gripper.
Figure 8:
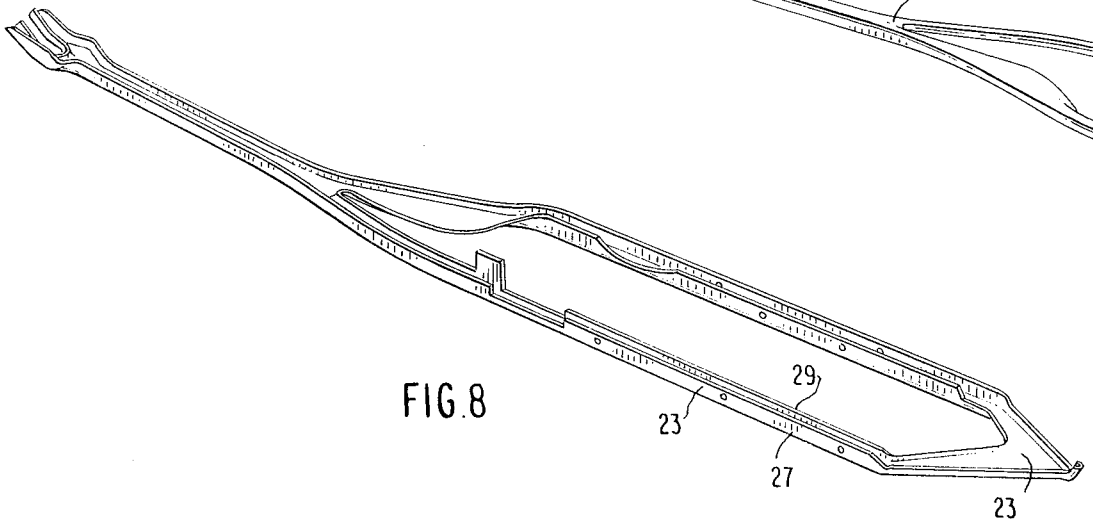
FIG. 8 is a bottom perspective view of the upper shell of FIG. 7.

Body 1 is comprised of an upper metal shell 3, of for example steel, which is shown per se in FIGS. 2 and 3. It will be seen that shell 3 is comprised by a main web portion 5 having downwardly depending marginal flanges 7 which terminate in ears 9.

Figure 5:
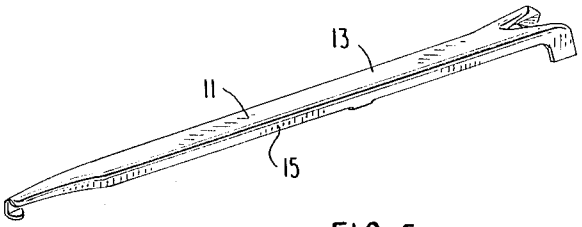
FIG. 5 is a bottom perspective view of the lower metal shell of FIG. 4.
Figure 4:
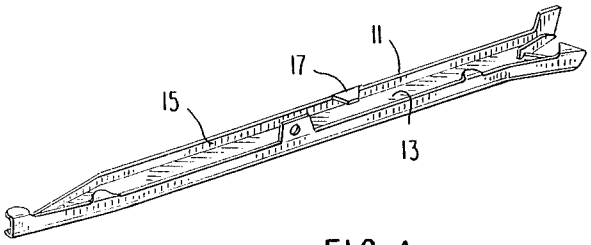
FIG. 4 is a perspective view, from the same angle as in FIG. 1, of the lower metal shell.

A lower shell 11, shown by itself in FIGS. 4 and 5, and also of steel, provides a hard and wear resistant liner for the underside of body 1 and is similarly comprised of a central web 13 which terminates edgewise in upstanding flanges 15, the flanges 15 at their margins remote from web 13 bearing ears 17.

Between the shells 3 and 5, is a body 19 of hard synthetic resin, e.g. a solid polyamide such as nylon, or an acetylic resin which may be loaded if desired with carbon fibers and/or glass fibers. The ears 9 and 17 of the perspective shells 3 and 11, are integrally molded within synthetic resin body 19.

Figure 6:
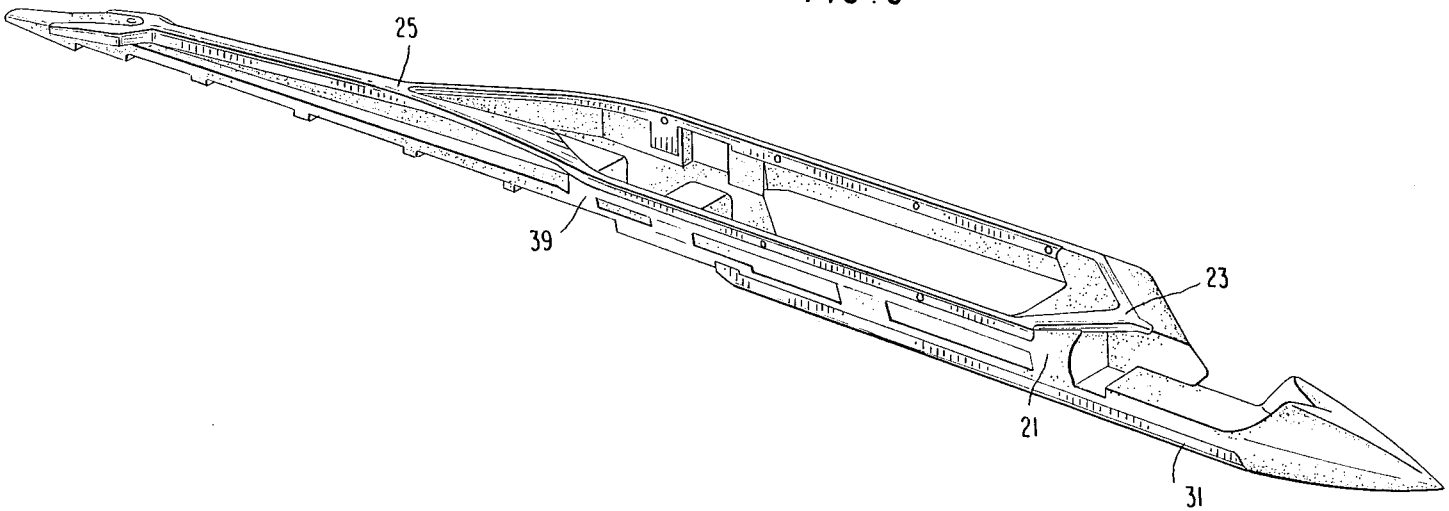
FIG. 6 is a perspective view of the body of a drawing gripper according to the present invention.
Figure 10:
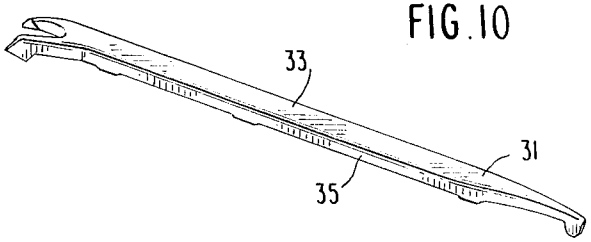
FIG. 10 is a bottom perspective view of the lower metal shell of FIG. 9.
Figure 9:
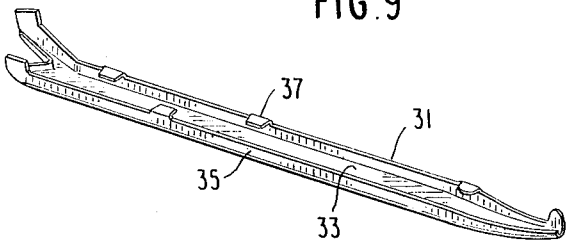
FIG. 9 is a perspective view, from the same angle as in FIG. 6, of the lower metal shell of FIG. 6.

Turning now to FIGS. 6–10, there is shown in FIG. 6 a body 21 of a drawing gripper according to the present invention. As in the case of the body 1 of the carrying gripper, body 21 of the drawing grippers serves to support mechanism for grasping and drawing and releasing a weft yarn, this mechanism being omitted from the present drawings for purposes of clarity. However, a full disclosure of such mechanism of a drawing gripper can be found in U.S. Pat. No. 4,505,305, the disclosure of which is incorporated herein by reference. As before, however, this known mechanism forms no part of the present invention.

Body 21 carries an upper shell 23 of sheet steel having a web portion 25 and downwardly depending flanges 27. However, instead of having ears as in the previous embodiment, the embodiment of FIGS. 6–10 has flanges 29 on the inner sides of web portion 25, the flanges 27 and 29 having holes therethrough that are penetrated by the synthetic resin at the time body 21 is produced by injection molding, thereby bonding the upper shell 23 to body 21.

Body 21 also bears a lower shell 31 on the opposite side of body 21 from upper shell 23, and also of sheet steel, and comprising a web portion 33 having marginal upstanding flanges 35 that terminate in ears 37. As also in the case of body 1, the ears 37 of the drawing gripper are embedded in a body 39 of hard synthetic resin (which can be the same as for the drawing gripper), with the result that the upper and lower shells 23 and 31 are thus made integral with body 39 and are spaced apart from each other by body 39.

To make the grippers of the present invention, the upper and lower shells are formed by stamping and bending and are then placed in their desired final positions, in a mold having the exact internal configuration of the body 1 or 21 to be produced. Preferably, the shells themselves are made by drawing steel of a thickness of 0.1 to 0.3 millimeter, which has been subjected to a surface hardening treatment or to a chromium coating treatment.

The molten synthetic resin is then injected into the mold, which can be a conventional injection molding machine, at a temperature of about 150°-200° C., wherein it surrounds the inner portions of the respective shells and causes the ears 9, 17 or 37 or the apertured flanges 29 to become embedded in the synthetic resin and, upon hardening of the thermoplastic synthetic resin, to become integrated with the body of the gripper.

The result is a gripper body having, on each of its wear receiving opposite surfaces, a steel surface that is sufficiently wear resistant. These steel surfaces are maintained spaced apart by synthetic resin bodies 19 or 39, which not only reduce the weight of the gripper, but also space apart the metal shells of the respective gripper a distance sufficient to impart substantial bending moment to the construction thanks to the resistance to bending of two steel members that are spaced apart by a substance that rigidly interconnects them. Thus, the resistance to bending of the two steel shells, is substantially greater than the sum of the individual resistances to bending of the respective steel shells.

The present invention thus achieves the rigidity and wear resistance of a steel gripper construction, with the light weight and low cost of a synthetic resin gripper construction.

Although the present invention has been described and illustrated in connection with preferred embodiments, it is to be understood that modifications and variations may be resorted to, without departing from the spirit of the invention. Such modifications and variations are considered to be within the purview of the present invention as defined by the appended claims.

What is claimed is:

1. A weft gripper for a shuttleless weaving loom, comprising a composite structure consisting of two metal shells rigidly connected to each other by a central body of hard synthetic resin, said shells being partially molded in the synthetic resin and presenting exposed hard metallic surfaces on opposite sides of the gripper.

2. A gripper as claimed in claim 1, in which said synthetic resin spaces apart said shells from each other.

3. A gripper as claimed in claim 1, each said shell having a web portion and marginal flanges, and means carried by the marginal flanges and embedded in said synthetic resin.

4. A gripper as claimed in claim 3, in which said means are ears on said marginal flanges.

5. A gripper as claimed in claim 3, in which said means are the margins of apertures through said flanges.

* * * * *